US007138970B2

(12) United States Patent
Krohn

(10) Patent No.: US 7,138,970 B2
(45) Date of Patent: Nov. 21, 2006

(54) METHOD OF LED LIFE EXTENSION AND END-OF-LIFE PREDICTION

(75) Inventor: Robert M. Krohn, Ithaca, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 361 days.

(21) Appl. No.: 10/314,225

(22) Filed: Dec. 9, 2002

(65) Prior Publication Data

US 2004/0108982 A1 Jun. 10, 2004

(51) Int. Cl.
*G09G 3/32* (2006.01)
*G09G 3/30* (2006.01)

(52) U.S. Cl. ..... 345/82; 345/76; 345/77

(58) Field of Classification Search ..... 345/36–39, 345/44–50, 76–82
See application file for complete search history.

(56) References Cited

U.S. PATENT DOCUMENTS

| | | | | |
|---|---|---|---|---|
| 4,377,742 A | 3/1983 | Kawabata et al. | ..... | 250/204 |
| 4,468,631 A | 8/1984 | Goldberg | ..... | 330/284 |
| 4,907,862 A * | 3/1990 | Suntola | ..... | 349/61 |
| 5,175,528 A * | 12/1992 | Choi et al. | ..... | 340/331 |
| 5,280,162 A | 1/1994 | Marwin | ..... | 235/462 |
| 5,532,467 A | 7/1996 | Roustaei | ..... | 235/472 |
| 5,770,847 A | 6/1998 | Olmstead | ..... | 235/462 |
| 6,534,763 B1 * | 3/2003 | Krohn et al. | ..... | 250/239 |
| 6,717,559 B1 * | 4/2004 | Weindorf | ..... | 345/82 |
| 2004/0001040 A1 * | 1/2004 | Kardach et al. | ..... | 345/102 |

* cited by examiner

*Primary Examiner*—Vijay Shankar
(74) *Attorney, Agent, or Firm*—Schwartz & Weinrieb

(57) ABSTRACT

A method or technique of operating the LED illumination system within a line scan camera comprises the operation of the LED illumination sources at a relatively high gain control level, less than the one hundred percent maximum or acceptable gain level, and a correspondingly reduced duty cycle level, which is less than one hundred percent (100%), so as to effectively reduce the aging of the LEDs and thereby achieve extended service lives for the LEDs. As the LEDs age with usage, whereby their luminosity levels degrade, the duty cycle percentage level is progressively increased until a maximum output or one hundred percent duty cycle percentage level is reached at which time the gain control percentage is progressively increased up until the maximum acceptable gain percentage level. An end-of-life prediction technique or routine is also capable of being derived from the progressively increased gain control percentages so as to enable the replacement of the LED illumination sources at appropriate times.

18 Claims, 3 Drawing Sheets

METHOD OF LED LIFE EXTENSION AND END-OF-LIFE PREDICTION

FIELD OF THE INVENTION

The present invention relates generally to light emitting diode (LED) illumination systems for use, for example, within line scan cameras, and more particularly to a new and improved method or technique for effectively extending the service life of LED illumination sources, as well as a related new and improved method or technique for predicting the end of the service life of the LED illumination sources whereupon the LED illumination sources will need to be replaced.

BACKGROUND OF THE INVENTION

With the advent of those particular light emitting diodes (LEDs) which generate bright-white light whereby such light emitting diodes (LEDs) can be used as viable and reliable illumination sources, many imaging systems, such as, for example, cameras, are replacing conventional incandescent illumination systems with LED-based illumination systems. The use of LEDs as a source of illumination for imaging systems has many operational advantages, as compared to conventional incandescent illumination systems, such as, for example, longer service life, lower power consumption, lower heat generation, and lower infrared color spectrum. On the other hand, white LEDs pose some operational challenges when viewed from an overall life-cycle perspective point of view. More particularly, for example, white LEDs are expensive as compared to monochromatic LEDs, such as, for example, red LEDs. In addition, relatively large quantities of the white LEDs are required in order to provide a requisite or sufficient amount of illumination. As a result, a white LED illumination system requires a relatively high acquisition and implementation cost relative to conventional incandescent illumination systems. Still yet further, white LEDs have an inherent operational characteristic of gradually losing their relative brightness levels during their service lives.

More specifically, white LEDs contain a phosphor substance that fluoresces so as to generate much of the white color spectrum, and overlying the phosphor substance is a clear plastic lens. It has been discovered, however, that over a period of time, the clear plastic lens tends to yellow due to the light frequencies that are generated, and in turn, the yellowing of the plastic lens effectively tends to lower the light output from the white LEDs. More particularly, there are several operational factors which not only lead to the aforenoted yellowing of the plastic lens, but in addition, such factors also affect the rate at which the plastic lens undergoes such a yellowing process. A first contributing factor comprises the amount of time that the LED is disposed in its ON state, a second contributing factor comprises the temperature of the LED, and a third contributing factor comprises the amount of current which is being conducted through the LED. For example, with reference being made to FIG. 1, there is disclosed a graphical plot which clearly illustrates the gradual deterioration or degradation of the RELATIVE LUMINOSITY, luminance, or brightness, of white LEDs, as a function of OPERATING TIME, under similar temperature conditions of 25° C., but under different current amperage conditions in milliamps. As can be readily appreciated from FIG. 1, when the LEDs are operated at a substantially higher current level, that is, for example, at 20 ma, as depicted by means of graph B, as opposed to 10 ma, as depicted by means of graph A, the onset of the deterioration or degradation of the relative luminosity occurs at an earlier point in operational time, with the ultimate result being that the luminosity of the LED decays to, for example, an unacceptable level within a shorter period of time so as to effectively define a substantially shorter service life for the white LED.

Continuing further, conventional imaging systems, such as, for example, cameras, normally contain at least one mechanism for operatively affecting the brightness of the illumination system, and therefore, in connection with the use of a white LED illumination system, such mechanism or mechanisms would effectively be capable of compensating for the aforenoted deterioration or degradation in the produced brightness of the illumination system. Such operative compensating mechanisms typically control exposure and comprise, for example, an iris control mechanism and a gain control mechanism. The iris control mechanism or f/stop adjusts and affects the aperture size so as to directly control the amount of light that is transmitted to and passed through the lens, while the gain control mechanism comprises an electronic adjustment that is applied to or impressed upon the video circuits of the digital camera that control the amplification of the video signals from their source, such as, for example, a charge-coupled device (CCD) sensor. When these two control mechanisms are properly set or adjusted, the exposure level of the imaging system is correct. It is to be appreciated, however, that both the iris and gain control mechanisms have practical limits which, in reality, affect or limit the extents to which the exposure levels can in fact be affected. For example, the iris control mechanism is limited by the size of the imaging system lens as well as the depth of field required by the system. The gain control mechanism is effectively limited by the amount of noise that is acceptable to, or which can be tolerated by, the system. As gain is increased so as to effectively compensate for low illumination levels, the noise is likewise increased. Accordingly, there is a point or limit beyond which gain can no longer be increased due to the fact that the corresponding noise levels would be too high and therefore unacceptable with respect to the desired imaging capabilities or characteristics of the system.

In light of the foregoing, it can readily be appreciated that all conventional imaging systems are therefore predeterminedly designed in such a manner that the iris and gain control settings have built-in margins or tolerances whereby the iris and gain control settings are not normally or originally operated at their upper or absolute limits so as to effectively provide for subsequent adjustments as will become necessary. A typical or conventional system will therefore initially operate at such "normal" levels until such time that the illumination, luminosity, or luminance levels characteristic of the system drop to such an extent that one or both of the iris and gain control settings must be adjusted so as to effectively compensate for such a drop or loss in the illumination, luminosity, or luminance level in order to in fact maintain proper system exposure parameters or levels. During the time that such adjustments are being implemented, the image quality, as measured or determined by means of the depth of field and noise characteristics, will be adversely affected, and eventually, effective exposure compensation terminates when the real or practical limits of the depth of field or noise are exceeded. The aforenoted procedures may be graphically appreciated from FIG. 2 which is a graphical plot of both RELATIVE LUMINOSITY and GAIN as a function of OPERATING TIME.

More particularly, it can be appreciated that the graphical plot of RELATIVE LUMINOSITY, or GENERATED LED ILLUMINATION, of FIG. 2 is substantially similar to the graphical plots illustrated within FIG. 1, that is, the LED illumination will in fact deteriorate or degrade as the service operating time of the LEDs increases. Correspondingly, for example, and separate and apart from any adjustments which may be made to the iris control mechanism, adjustments in the gain control mechanism may be accordingly implemented so as to effectively counteract, compensate for, or offset, such deterioration or degradation in the LED illumination levels. Therefore, in accordance with conventional imaging system operational techniques, when the LED illumination components are fresh or new, the gain control mechanism is intentionally set or adjusted to a predetermined operative level of, for example, approximately forty percent (40%) of the maximum obtainable gain, and as the LED illumination levels deteriorate or degrade over time, the gain levels are correspondingly increased so as to effectively counteract, offset, or compensate for such loss, deterioration, or degradation in the LED illumination levels. It is of course readily appreciated from the graphical plot of FIG. 2 that eventually, viable gain adjustments can no longer be implemented in view of the fact that the gain level reaches 100% MAXIMUM OBTAINABLE GAIN, meaning, that if the gain signals are increased still further beyond such level, the resulting noise levels effectively impressed upon the resultant imaging scans would render the same unacceptable or undesirable. Accordingly, it can be readily appreciated still further, as graphically illustrated within both FIGS. 1 and 2, that the LEDs will in fact continue to age relatively quickly. It is lastly noted, in conjunction with the graphical plot of the sensor gain adjustments, that such adjustments have been graphically illustrated in a stepwise manner, however, over a substantially extended period of time, such graphical plot will effectively exhibit a substantially linear increase in such sensor gain adjustments.

Continuing further, and in light of the foregoing, it can readily be understood that as a result of the relatively rapid aging of the LEDs, and in view of the fact that when the illumination levels of the LEDs therefore degrade or deteriorate to those levels which cannot effectively be corrected by means of the imaging system exposure controls, the illumination system must be replaced. Obviously, the economic impact of relatively high replacement costs, coupled with a foreshortened useful life expectancy effectively dictated by means of constantly deteriorating or degrading illumination levels, can have a substantial negative effect upon the implementation and operational costs of such a system over its entire service lifetime. Still yet further, it is likewise important, from a cost-effective point of view, to know, as accurately as possible, precisely when the LEDs will no longer be capable of delivering the requisite illumination levels such that the LEDs can be replaced at the appropriate time, as opposed to being replaced prematurely and therefore needlessly, or alternatively, as opposed to being replaced after such appropriate time has occurred whereby the system would have to be operated under less than desirable or acceptable illumination levels. In addition, in order to prevent the need to operate the system beyond the appropriate replacement time, such as, for example, when replacement LEDs may not be readily available, a needless oversupply or large inventory of LEDs would otherwise need to be provided.

A need therefore exists in the art for a new and improved technique by means of which the substantially rapid aging of LED illumination sources, which results in a substantially rapid decay, deterioration, or degradation in the illumination levels of the LED illumination sources, can effectively be forestalled or delayed such that the real or effective service life of the LED illumination sources may be enhanced so as to, in turn, significantly reduce system implementation and operating costs, and wherein further, a need exists in the art for a new and improved technique by means of which the true service life of the LED illumination sources may be more accurately determined, forecasted, and predicted such that operator or maintenance personnel can more accurately monitor the illumination levels of the LED illumination sources and effectuate the replacement of the LED illumination sources as necessary at the appropriate times.

OBJECTS OF THE INVENTION

Accordingly, it is an object of the present invention to provide a new and improved method or technique for operating LED illumination systems so as to effectively extend the service life of the LED illumination sources, as well as to provide a new and improved method or technique for predicting the end of the service life of the LED illumination sources whereupon the LED illumination sources can be replaced at appropriate operational times.

Another object of the present invention is to provide a new and improved method or technique for operating LED illumination systems which is effectively contrarian to conventional PRIOR ART methods or techniques of operating LED illumination systems.

An additional object of the present invention is to provide a new and improved method or technique for operating LED illumination systems which is effectively contrarian to conventional PRIOR ART methods or techniques of operating LED illumination systems whereby, in lieu of the LED illumination sources exhibiting relatively shortened service lives as a result of substantially rapidly deteriorating, degrading, or decaying illumination levels as a function of time, the LED illumination sources will exhibit relatively extended service lives.

A further object of the present invention is to provide a new and improved method or technique for predicting the end of the service life of the LED illumination sources whereupon the LED illumination sources can in fact be replaced at truly appropriate operational times so as not to be unnecesarily prematurely replaced, or alternatively, so as not to be inappropriately maintained in service whereby the imaging system can no longer in fact be used or wherein the imaging capabilities are unacceptably compromised.

A last object of the present invention is to provide a new and improved method or technique for operating LED illumination systems so as to effectively extend the service life of the LED illumination sources, as well as to provide a new and improved method or technique for predicting the end of the service life of the LED illumination sources whereupon the LED illumination sources can be replaced at appropriate operational times, all of which positively impact the economics concerning the implementation and operational maintenance of the imaging systems within which the LED illumination sources are being utilized.

SUMMARY OF THE INVENTION

The foregoing and other objectives are achieved in accordance with the teachings and principles of the present invention through the provision of a new and improved method, technique, or scheme for effectively operating LED illumination sources within, for example, line scan imaging cameras, wherein, in accordance with the unique and novel method or technique of the present invention, and contrary to conventional methods or techniques of operating LED illumination sources wherein the LED illumination sources are initially driven or operated at their maximum output levels or duty cycles, and controlled by means of relatively low sensor gain signals which are then incrementally increased as the illumination levels of the LED illumination sources deteriorate or degrade, the LED illumination sources of the present invention are initially driven or operated at only a fractional percentage of their maximum output levels or duty cycles, and are controlled by means of relatively high compensatory sensor gain controls which are still less than the maximum gain. In view of the fact that the LEDs are being operated at only a fraction of their maximum duty cycles, they are not always in their ON states whereby when they are in their OFF states, they are not subjected to the aging process and their life expectancy is accordingly multiplied and enhanced. As time passes, and the illumination levels of the LEDs begin to deteriorate or degrade, the sensor gain is maintained constant while the duty cycles of the LEDs are increased. Still further, when the duty cycles of the LEDs reach one-hundred percent (100%), that is, after the LEDs are now always disposed in their ON states, then the sensor gain control is incrementally increased until maximum gain is reached. At this point in time, the LEDs will need to be replaced in order to preserve acceptable imaging capabilities and quality imaging characteristics. In conjunction with the incremental increases in the gain control, plotted graphical data of the incremental increases in gain control as a function of time can provide an extrapolation or interpolation of when the maximum gain level will be reached whereby the end-of-life of the LED, that is, when the same needs to be replaced, can be projected or forecasted.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
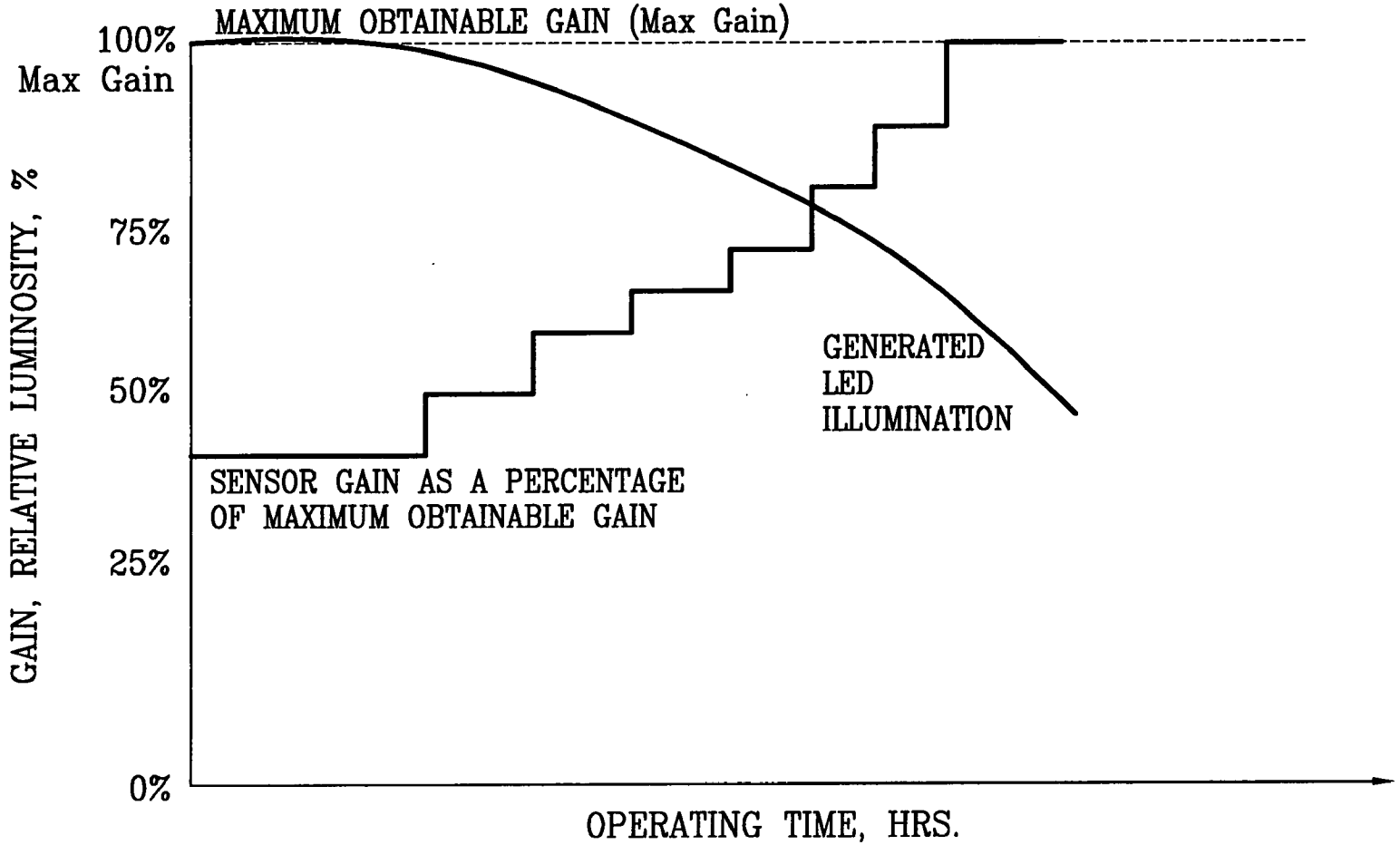
FIG. 2 is a graphical plot, similar to that of FIG. 1, illustrating the fact that in order to effectively counteract or offset the deterioration or degradation of the illumination levels of white LEDs as a function of time, incrementally increasing sensor gain control signals can be utilized to maintain the illumination levels at desirably elevated levels up until the point at which maximum gain is reached.
Figure 3:
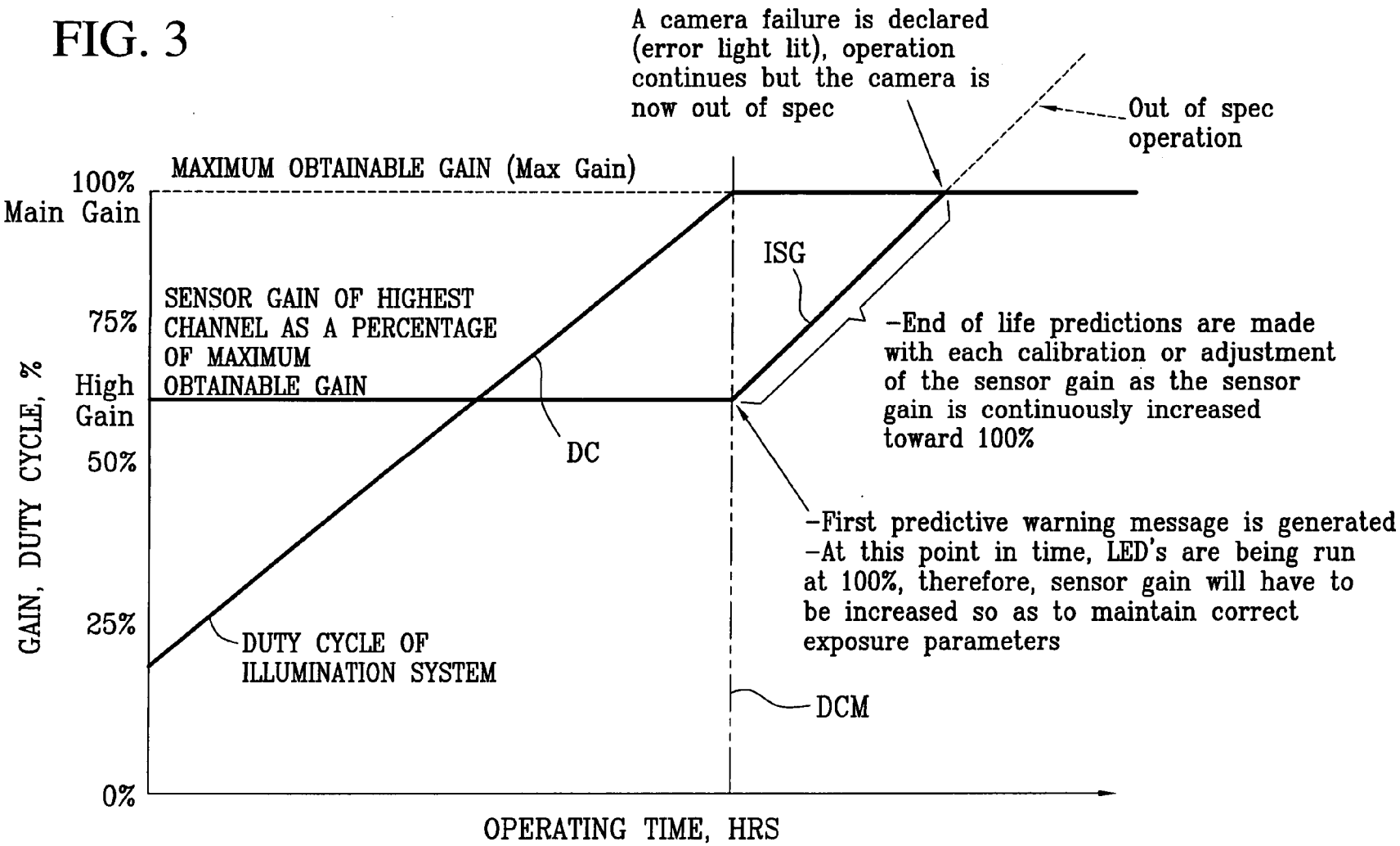
FIG. 3 is a graphical plot illustrating the new and improved operating method or technique developed in accordance with the principles and teachings of the present invention wherein, contrary to conventional methods or techniques of operating LED illumination sources wherein the LED illumination sources are initially driven or operated at their maximum output levels or duty cycles, and controlled by means of relatively low sensor gain signals which are then incrementally increased as the illumination levels of the LED illumination sources deteriorate or degrade, the LED illumination sources of the present invention are initially controlled by means of relatively high compensatory sensor gain controls, which are less than maximum gain, and are accordingly driven or operated at only a fractional percentage of their maximum output levels or duty cycles whereby the LEDs are not always subjected to the aging process, their life expectancy is accordingly multiplied and enhanced, and as time passes, resulting in the deterioration or degradation of the LED illumination levels, both the sensor gain and duty cycle percentage are increased.

Referring now to the drawings, and more particularly to FIG. 3 thereof, there is illustrated a graphical plot of DUTY CYCLE and GAIN parameters, characteristic of, for example, a particular white LED being used as an illumination source within an imaging system, as a function of TIME, wherein such graphical plot is illustrative of the new and improved method or technique, developed in accordance with the principles and teachings of the present invention, for operating imaging system LED illumination sources in such a manner that the LED illumination sources will achieve and exhibit extended or enhanced service lives. More particularly, in lieu of, or contrary to, the conventional PRIOR ART practice of running or operating the LED illumination sources wherein the LED illumination sources are initially normally operated at their maximum output levels or in accordance with a one hundred percent (100%) duty cycle, and in conjunction therewith, wherein the sensor gain control is predeterminedly initially set at a relatively low level of, for example, approximately forty percent (40%) of the maximum obtainable or maximum acceptable gain, as graphically illustrated within FIG. 2, in accordance with the method or technique characteristic of the principles and teachings of the present invention, the sensor gain level is intentionally set at a predetermined relatively high level of, for example, sixty percent (60%) of the maximum obtainable or maximum acceptable gain. This HIGH GAIN level is significantly higher than is normally required in connection with the use of new or fresh LED illumination sources being operated at their normal maximum output levels or in accordance with their one hundred percent (100%) duty cycles, because the LEDs have not as yet begun to age whereby the emitted illumination levels of such LED illumination sources have not as yet begun to deterioriate or degrade, and accordingly, the imaging system will experience or exhibit overexposure conditions. Consequently, in order to effectively compensate for such HIGH GAIN levels, the light output levels of the LEDs are effectively reduced in order to in fact achieve proper exposure conditions for the imaging system. Accordingly, by modulating the LED current with a relatively high frequency, low duty cycle, such as, for example, on the order of twenty percent (20%), the LED light output is reduced. This state or condition is graphically illustrated at the extreme left side edge portion of the graphical plot, that is, the gain control has been set at the HIGH GAIN level of sixty percent (60%), and the DUTY CYCLE has been initiated at the twenty percent (20%) level.

In light of the foregoing, several significant results have been able to be achieved. Firstly, it is to be appreciated that when the LEDs are being operated in accordance with a twenty percent (20%) duty cycle, this means that the LEDs are OFF eighty percent (80%) of the time, and correspondingly, are ON only twenty percent (20%) of the time. Recalling the fact that LEDs only age, turn yellow, or grow dim, whereby their emitted illumination levels begin to deteriorate or degrade, when they are in their ON states, the life expectancy of the LEDs is effectively multiplied by means of a factor of five as compared to LEDs which are operated or run without modulation, that is, at their maximum output levels or at a one hundred percent duty cycle. Furthermore, modulation of the LEDs also results in the generation of less heat whereby the LEDs operate as if the current or operating amperage has been lowered. This effectively reduced current level likewise leads to a reduction in the LED aging process, and together with the actual modulation or reduction in the LED duty cycle, the LEDs will tend to have their life expectancy increased by means of a factor of more than seven. Still yet further, additional modulation options in connection with the actual operation of the LED illumination sources, whereby corresponding improvements in life expectancy can be achieved, may comprise, for example, turning the LEDs completely OFF when no imaging is being performed, or similarly, turning the LEDs completely OFF during those time intervals between scans.

Figure 1:
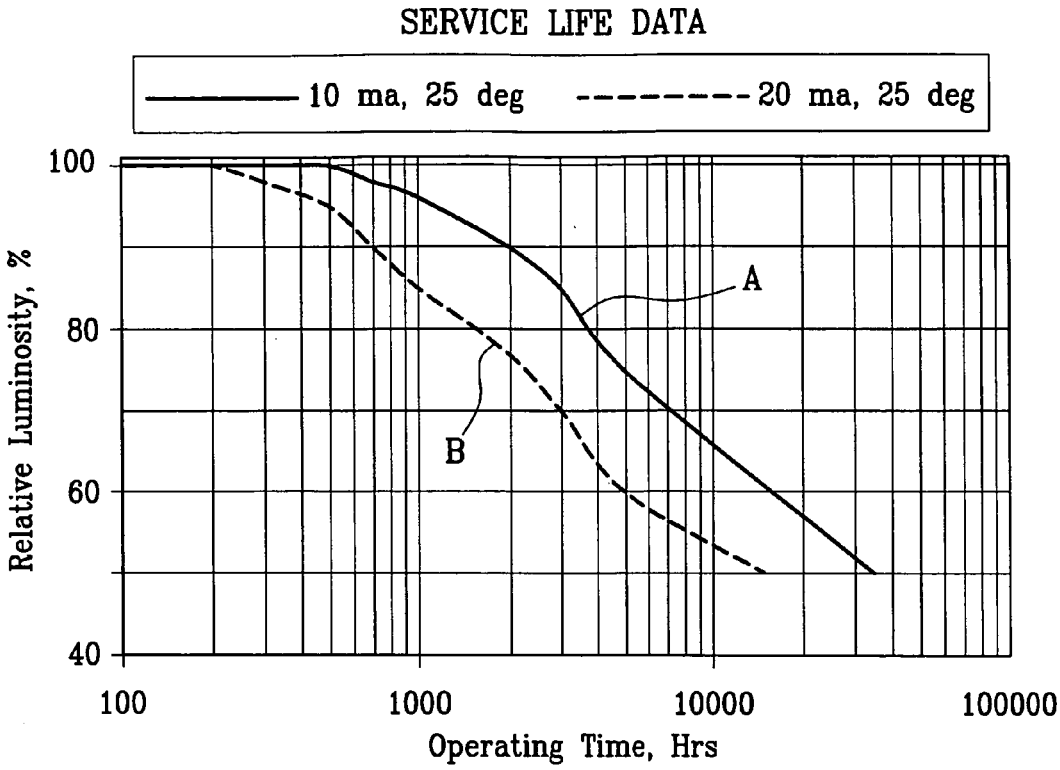
FIG. 1 is a graphical plot showing the typical deterioriation or decay in the relative luminosity of white LED illumination sources as a function of time wherein the LED illumination sources are being operated at their maximum output levels or duty cycles, under predetermined temperature conditions, and in accordance with two different operative amperage modes of 10 ma and 20 ma.

With reference continuing to be made to FIG. 3, and recalling, as graphically illustrated within FIG. 1, that the LEDs will in fact age with time and usage, as a result of which their emitted illumination levels will begin to deteriorate or degrade, then as operational time passes or accumulates, the emitted illumination levels of the LEDs will begin to deteriorate or degrade whereby compensatory or counteractive measures must be implemented so as to maintain the emitted illumination levels at predeterminedly acceptable levels of relative luminosity. Accordingly, as can in fact be readily appreciated from FIG. 3, and in accordance with the unique and novel method or technique characteristic of the present invention, as the emitted illumination levels of the LEDs begin to deteriorate or degrade, the sensor gain is maintained at its initially pre-set HIGH GAIN value of, for example, sixty percent (60%), however, the duty cycle of the illumination system is progressively increased as graphically illustrated by the graphical plot line DC. The operation of the imaging illumination system is of course continued in accordance with this operative phase of the method or technique characteristic of the present invention until that point in time, denoted as DCM, is reached at which the illumination system LEDs are being operated at their maximum output levels or in accordance with a duty cycle of one hundred percent (100%), that is, the illumination LEDs are now always disposed in their ON states.

As time continues to pass, and since the LEDs are now being operated at their maximum output levels, the LEDs will continue to age whereby the emitted illumination levels of the LEDs continue to deteriorate or degrade further. Since, at this point in time, the LEDs are already being operated at their maximum output levels or in accordance with a duty cycle of one hundred percent (100%), the operational duty cycle of the LEDs cannot be increased any further so as to compensate for or counteract the aforenoted continued deterioration or degradation in the emitted illumination levels. Accordingly, the gain control is now incrementally adjusted upwardly or increased from the initial predeterminedly set HIGH GAIN value of sixty percent (60%), as denoted by means of the graphical plot line ISG, so as to maintain the proper exposure parameters or characteristics. It is noted that as the gain is increased, image quality is impacted and affected due to increasing noise levels, however, such noise levels are still within an acceptable range or within tolerable limits.

At this point in time, that is, at the time denoted as DCM wherein the LEDs are being operated at their maximum output levels or duty cycle, and wherein the sensor gain has begun to be increased from its previously constant HIGH GAIN level, a first predictive warning message may be generated within the imaging system, indicating the aforenoted state of the LEDs and the onset of the sensor gain adjustment phase, and in addition, data is collected in connection with the required sensor gain percent settings or levels as a function of time. Eventually, as time continues to pass still further, the sensor gain control or adjustment reaches the MAXIMUM OBTAINABLE GAIN or 100% MAXIMUM GAIN level at which time further exposure compensation can no longer be attained due to the fact that if gain control is increased further, the noise level impressed upon the images generated by means of the imaging system would be unacceptable. Therefore, at this point in time, if the imaging system continues to be operated, it is operating in an OUT OF SPEC mode, or alternatively, operation of the imaging system is in fact terminated whereby the LED illumination sources need to be, and will be, replaced. At this point in time, an ERROR light or lamp may also, optionally, be automatically illuminated so as to apprise operator or maintenance personnel that a camera failure has effectively occurred necessitating replacement of the illumination LEDs.

Figure 4:
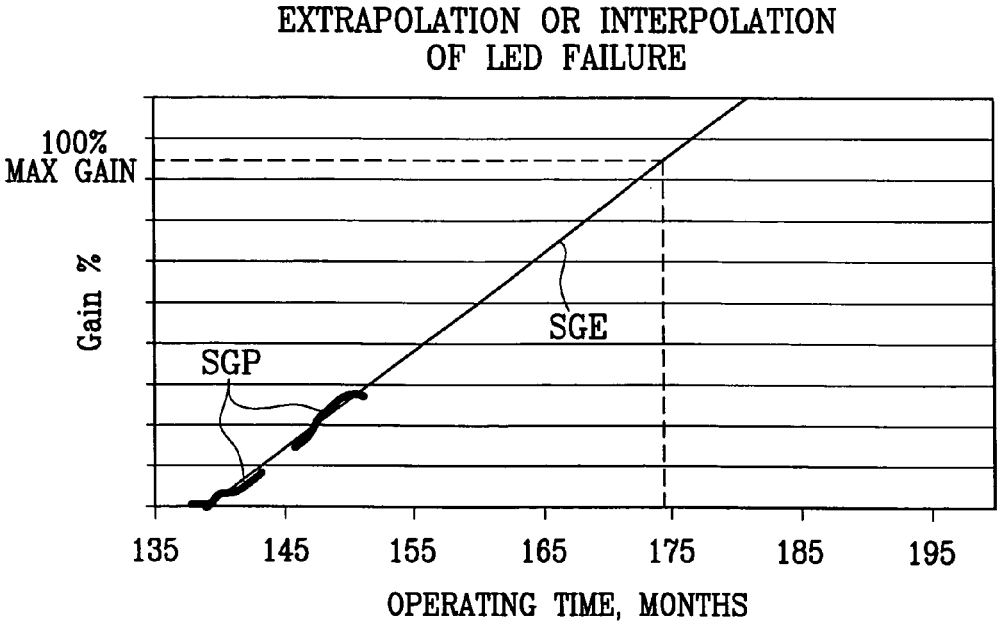
FIG. 4 is a graphical plot of actual gain control values as a function of time for a particular LED illumination source by means of which an extrapolation or interpolation of when the maximum gain level will be reached can be attained so as to effectively predict or forecast the end-of-life of the LED.

With reference lastly being made to FIG. 4, it is to be recalled that when the process, method, or technique of operating the LED illumination devices, in accordance with the principles and teachings of the present invention, effectively enters the second phase of the process or technique wherein the sensor gain control is incrementally increased, data is collected concerning the sensor gain control settings or percentages as a function of time. Therefore, in accordance with a last important method or technique uniquely characteristic of the present invention comprises the use of such sensor gain-time line data as a means for effectively predicting the end-of-life of the LED illumination sources, that is, when the LEDs actually need to be replaced. More particularly, as can be appreciated from FIG. 4, actual sensor gain control percentage data is plotted as a function of operating time, as shown at SGP, and as a result of such data, and from such data, an extrapolated plot of sensor gain control as a function of time, as shown at SGE, can be generated. Accordingly, the time at which the extrapolated plot SGE intersects the MAXIMUM OBTAINABLE GAIN or 100% MAXIMUM GAIN level will give or generate an estimated or projected time, in months, at which the imaging system will in effect reach its OUT OF SPEC operating level as can be appreciated from a comparison of the graphical plots of FIGS. 3 and 4. This point in operating time therefore defines the LED illumination source END-OF-LIFE. It is noted that such a prediction or extrapolation for a particular imaging system is actually quite accurate in view of the fact that the plotted data SGP, from which the prediction or extrapolation is generated or forecast, is based upon the actual operating service profile of the particular imaging system.

In accordance with the illustrated graphical plot, for example, it is seen that the imaging system will reach its end-of-life or systems failure in approximately the one hundred seventy-fourth ($174^{th}$) month. This data is important to logistics or maintenance personnel in that such data provides such personnel with meaningful data which will permit them to substantially accurately predict the end-of-life of the LED illumination sources. In this manner, replacement components can be ordered in a timely fashion whereby such replacement components will in fact be available and in stock when needed such that extensive downtime of the imaging system does not occur, or alternatively, the imaging system need not be operated in an OUT OF SPEC mode. It is noted in conjunction with the graphical plot of FIG. 4 that the plotted data SGP appears discontinuous, and the reason for this is that it is to be noted that if the imaging system is not actually used for a significant or substantial period of time, that is, over a period of, for example, several months, then when operation of the imaging is again continued, the plotted data indicates that the operating parameters and control settings will continue or resume as if the imaging system itself had experienced continued usage.

Thus, it may be seen that in accordance with the principles and teachings of the present invention, there has been developed or created a new and improved method or technique, and software for implementing such method or technique, for operating the LED illumination sources by means of which the aging of the LED illumination sources can be effectively compensated for or counteracted to a significant degree whereby the useful service life of LED illumination sources may accordingly be significantly extended, and in addition, there has also been developed or created a new and improved method or technique, and software for implementing such method or technique, for effectively predicting the END-OF-LIFE of the LED illumination sources whereby the LED illumination sources can be replaced at the appropriate time as opposed to being prematurely replaced, or alternatively, as opposed to requiring the imaging system to be operated in an OUT-OF-SPEC operational mode.

In light of the above teachings, it is to be appreciated that many variations and modifications of the present invention are possible. It is therefore to be understood that within the scope of the appended claims, the present invention may be practiced otherwise than as specifically described herein.

What is claimed as new and desired to be protected by Letters Patent of the United States of America, is:

1. A method of extending the service life of an LED illumination source being used within an illumination system, comprising the steps of:

initially impressing a predetermined gain control signal, having a relatively high percentage gain level, upon an LED illumination source such that said LED illumination source will consequently tend to exhibit a luminosity level which is greater than a predeterminedly desired luminosity level;

initially operating said LED illumination source at a predetermined duty cycle percentage which is less than a maximum one-hundred percent (100%) duty cycle percentage so as to effectively reduce said luminosity level of said LED illumination source to said predeterminedly desired luminosity level, whereby as a result of said LED illumination source being operated at said duty cycle percentage which is less than said maximum one-hundred percent (100%) duty cycle percentage, the aging of said LED illumination source is reduced whereby said service life of said LED illumination source is extended;

progressively increasing said duty cycle percentage of said LED illumination source over a predetermined period of time so as to progressively increase said luminosity level of said LED illumination source as said LED illumination source ages as a function of operative time so as to counteract said aging of said LED illumination source; and maintaining said gain control signal at said relatively high percentage gain level while said duty cycle percentage of said LED illumination source is progressively increased over said predetermined period of time.

2. The method as set forth in claim 1, wherein:

said predetermined duty cycle percentage, which is less than said maximum one hundred per cent (100%) duty cycle percentage, and at which said LED illumination source is initially operated, comprises a twenty per cent (20%) duty cycle percentage.

3. The method as set forth in claim 1, wherein:

said relatively high percentage gain level of said gain control signal, which is initially impressed upon said LED illumination source, comprises a percentage gain level of sixty per cent (60%) of the maximum gain level which is acceptable within said illumination system.

4. The method as set forth in claim 1, further comprising the steps of:

progressively increasing said duty cycle percentage of said LED illumination source over a predetermined period of time, so as to progressively increase said luminosity level of said LED illumination source as said LED illumination source ages as a function of operative time so as to counteract said aging of said LED illumination source, until a first predetermined point of operative time at which said LED illumination source is being operated at said maximum one-hundred percent (100%) duty cycle percentage; and progressively increasing said gain control signal, commencing at said first predetermined point of operative time at which said LED illumination source reaches said maximum one-hundred percent (100%) duty cycle percentage, from said relatively high percentage gain level, toward said maximum gain level which is acceptable within said illumination system, and until a second predetermined point of operative time at which said maximum gain level is reached.

5. The method as set forth in claim 4, further comprising the steps of:

plotting said progressively increased gain control signal percentage levels, commencing from said first predetermined point of operative time at which said LED illumination source reaches said maximum one-hundred percent (100%) duty cycle percentage, as a function of time so as to define a graphical plot of actual gain control signal percentage levels of said illumination system; and extrapolating said graphical plot up to said maximum gain level, as a function of operative time, so as to use said graphical plot in order to predict said second predetermined point of operative time at which said maximum gain level will be reached which indicates an end-of-life of said LED illumination source.

6. A method of extending the service life of an LED illumination source being used within an illumination system of a line scan camera, comprising the steps of:

initially impressing a predetermined gain control signal, having a relatively high percentage gain level, upon an LED illumination source such that said LED illumination source will consequently tend to exhibit a luminosity level which is greater than a predeterminedly desired luminosity level;

initially operating said LED illumination source at a predetermined duty cycle percentage which is less than a maximum one-hundred percent (100%) duty cycle percentage so as to effectively reduce said luminosity level of said LED illumination source to said predetermined desired luminosity level, whereby as a result of said LED illumination source being operated at said duty cycle percentage which is less than said maximum one-hundred percent (100%) duty cycle percentage, the aging of said LED illumination source is reduced whereby said service life of said LED illumination source is extended;

progressively increasing said duty cycle percentage of said LED illumination source over a predetermined period of time so as to progressively increase said luminosity level of said LED illumination source as said LED illumination source ages as a function of operative time so as to counteract said aging of said LED illumination source; and maintaining said gain control signal at said relatively high percentage gain level while said duty cycle percentage of said LED illumination source is progressively increased over said predetermined period of time.

7. The method as set forth in claim 6, wherein:

said predetermined duty cycle percentage, which is less than said maximum one hundred per cent (100%) duty cycle percentage, and at which said LED illumination source is initially operated, comprises a twenty per cent (20%) duty cycle percentage.

8. The method as set forth in claim 6, wherein:

said relatively high percentage gain level of said gain control signal, which is initially impressed upon said LED illumination source, comprises a percentage gain level of sixty per cent (60%) of the maximum gain level which is acceptable within said illumination system.

9. The method as set forth in claim 6, further comprising the steps of:

progressively increasing said duty cycle percentage of said LED illumination source over a predetermined period of time, so as to progressively increase said luminosity level of said LED illumination source as said LED illumination source ages as a function of operative time so as to counteract said aging of said LED illumination source, until a first predetermined point of operative time at which said LED illumination source is being operated at said maximum one-hundred percent (100%) duty cycle percentage; and progressively increasing said gain control signal, commencing at said first predetermined point of operative time at which said LED illumination source reaches said maximum one-hundred percent (100%) duty cycle percentage, from said relatively high percentage gain level, toward said maximum gain level which is acceptable within said illumination system, and until a second predetermined point of operative time at which said maximum gain level is reached.

10. The method as set forth in claim 9, wherein:

said maximum gain level, which is acceptable within said line scan camera imaging illumination system, is dictated by acceptable noise levels of the resulting images.

11. The method as set forth in claim 9, further comprising the steps of:

plotting said progressively increased gain control signal percentage levels, commencing from said first predetermined point of operative time at which said LED illumination source reaches said maximum one-hundred percent (100%) duty cycle percentage, as a function of time so as to define a graphical plot of actual gain control signal percentage levels of said illumination system; and extrapolating said graphical plot up to said maximum gain level, as a function of operative time, so as to use said graphical plot in order to predict said second predetermined point of operative time at which said maximum gain level will be reached which indicates an end-of-life of said LED illumination source.

12. Apparatus for extending the service life of an LED illumination source being used within an illumination system, comprising:

an LED illumination source;

means for initially impressing a gain control signal, having a relatively high percentage gain level, upon said LED illumination source such that said LED illumination source will consequently tend to exhibit a luminosity level which is greater than a predeterminedly desired luminosity level;

means for initially operating said LED illumination source at a predetermined duty cycle percentage which is less than a maximum one-hundred percent (100%) duty cycle percentage so as to effectively reduce said luminosity level of said LED illumination source to said predeterminedly desired luminosity level, whereby as a result of said LED illumination source being operated at said duty cycle percentage which is less than said maximum one-hundred percent (100%) duty cycle percentage, the aging of said LED illumination source is reduced whereby said service life of said LED illumination source is extended; and means for progressively increasing said duty cycle percentage of said LED illumination source over a predetermined period of time, so as to progressively increase said luminosity level of said LED illumination source as said LED illumination source ages as a function of operative time so as to counteract said aging of said LED illumination source, while also maintaining said gain control signal at said relatively high percentage gain level.

13. The apparatus as set forth in claim 12, further comprising:

means for progressively increasing said duty cycle percentage of said LED illumination source over a predetermined period of time, so as to progressively increase said luminosity level of said LED illumination source as said LED illumination source ages as a function of operative time so as to counteract said aging of said LED illumination source, until a first predetermined point of operative time at which said LED illumination source is being operated at said maximum one-hundred percent (100%) duty cycle percentage; and means for progressively increasing said gain control signal, commencing at said first predetermined point of operative time at which said LED illumination source reaches said maximum one-hundred percent (100%) duty cycle percentage, from said relatively high percentage gain level, toward said maximum gain level which is acceptable within said illumination system, and until a second predetermined point of operative time at which said maximum gain level is reached.

14. The apparatus as set forth in claim 13, further comprising:

means for plotting said progressively increased gain control signal percentage levels, commencing from said first predetermined point of operative time at which said LED illumination source reaches said maximum one-hundred percent (100%) duty cycle percentage, as a function of time so as to define a graphical plot of actual gain control signal percentage levels of said illumination system; and means for extrapolating said graphical plot up to said maximum gain level, as a function of operative time, so as to use said graphical plot in order to predict said second pre-determined point of operative time at which said maximum gain level will be reached which indicates an end-of-life of said LED illumination source.

15. The apparatus as set forth in claim 12, wherein:

said predetermined duty cycle percentage, which is less than said maximum one hundred per cent (100%) duty cycle percentage, and at which said LED illumination source is initially operated, comprises a twenty per cent (20%) duty cycle percentage.

16. The apparatus as set forth in claim 12, wherein:

said relatively high percentage gain level of said gain control signal, which is initially impressed upon said LED illumination source, comprises a percentage gain level of sixty per cent (60%) of the maximum gain level which is acceptable within said illumination system.

17. The apparatus as set forth in claim 12, wherein:

said predetermined duty cycle percentage, which is less than said maximum one hundred per cent (100%) duty cycle percentage, and at which said LED illumination source is initially operated, comprises a twenty per cent (20%) duty cycle percentage.

18. The apparatus as set forth in claim 12, wherein:

said relatively high percentage gain level of said gain control signal, which is initially impressed upon said LED illumination source, comprises a percentage gain level of sixty per cent (60%) of the maximum gain level which is acceptable within said illumination system.

* * * * *